US006986378B2

(12) United States Patent
Beaudoin et al.

(10) Patent No.: US 6,986,378 B2
(45) Date of Patent: Jan. 17, 2006

(54) BRAKING DEVICE FOR GARAGE DOORS AND THE LIKE

(75) Inventors: Michel Beaudoin, Drummondville (CA); Erik Nadeau, Levis (CA); Pierre-Louis Foucault, St-Lambert (CA); Jean-François Lévesque, St-Nicephore (CA); Pascal Provencher, Drummondville (CA); François Beaudoin, Drummondville (CA)

(73) Assignee: Canimex Inc., Quebec (CA)

( * ) Notice: Subject to any disclaimer, the term of this patent is extended or adjusted under 35 U.S.C. 154(b) by 0 days.

(21) Appl. No.: 10/391,731

(22) Filed: Mar. 19, 2003

(65) Prior Publication Data

US 2003/0221801 A1 Dec. 4, 2003

Related U.S. Application Data

(60) Provisional application No. 60/365,153, filed on Mar. 19, 2002.

(51) Int. Cl.
*E05F 11/00* (2006.01)

(52) U.S. Cl. ..... 160/191; 160/302; 49/322

(58) Field of Classification Search ..... 160/191, 160/192, 302; 16/401; 49/322; 385/45; 188/82.7

See application file for complete search history.

(56) References Cited

U.S. PATENT DOCUMENTS

| | | | |
|---|---|---|---|
| 229,983 A | 7/1880 | Ellwood | |
| 603,237 A | 4/1898 | Morrison et al. | |
| 636,645 A | 11/1899 | Dougherty | |
| 826,284 A | 7/1906 | Smith et al. | |
| 1,196,714 A | 8/1916 | Newbold | |
| 1,863,961 A | 6/1932 | Ball et al. | |
| 2,463,344 A | 3/1949 | Williams | 188/81.1 |
| 2,546,081 A | 3/1951 | Williams | 188/18.1 |
| 2,555,560 A | 6/1951 | Trimm | 242/107 |
| 2,878,865 A | 3/1959 | Manley | 160/189 |
| 3,236,348 A | 2/1966 | Okcuoglu | |

(Continued)

FOREIGN PATENT DOCUMENTS

DE 3402343 * 8/1985

(Continued)

*Primary Examiner*—Blair M. Johnson
(74) *Attorney, Agent, or Firm*—Merchant & Gould P.C.

(57) ABSTRACT

A braking device configured for use with the counterbalancing system of a garage door. The braking device includes a support bracket, a ratchet wheel, a pawl arm, and a biasing spring. The support bracket is rigidly connected to a fixed structure and has a guiding slot. The ratchet wheel is securely mounted about the overhead shaft of the counterbalancing system and has at least one notch. The pawl arm has first and second ends, the first end of the pawl arm being pivotally connected to the support bracket and the second end of the pawl arm cooperating with the guiding slot and being movable with respect to the support bracket along said guiding slot. The first and second ends of the pawl arm are further connected to flanges of a plug on either side of the overhead shaft. The biasing spring is operatively connected between the support bracket and the pawl arm so as to exert a biasing force for biasing the pawl arm towards the ratchet wheel. The pawl arm is devised so that, an element thereof is adjacent to the ratchet wheel, said element being shaped and sized to be removably insertable into at least one notch of the ratchet wheel so as to block rotation of the ratchet wheel, and thus block rotation of the overhead shaft, in the event of a failure of the counterbalancing system of the door.

20 Claims, 3 Drawing Sheets

U.S. PATENT DOCUMENTS

| | | | | |
|---|---|---|---|---|
| 3,842,892 | A | 10/1974 | Stieler | 160/133 |
| 3,895,539 | A | 7/1975 | Weman et al. | 74/575 |
| 4,116,314 | A | 9/1978 | Ackerman | 192/46 |
| 4,125,142 | A | 11/1978 | Fohl | 160/291 |
| 5,257,685 | A | 11/1993 | Tichiaz et al. | 192/46 |
| 5,494,093 | A | 2/1996 | Eiterman | 160/300 |
| 5,706,552 | A | 1/1998 | Hsieh | 16/82 |
| 5,971,055 | A | 10/1999 | Rohaut | 160/300 |
| 6,070,641 | A | 6/2000 | Budetti | 160/302 |
| 6,079,524 | A | 6/2000 | Hung | 188/184 |
| 6,102,480 | A | 8/2000 | Asano | 297/366 |
| 6,401,792 | B1 | 6/2002 | Mullet et al. | 160/188 |
| 6,431,619 | B1 | 8/2002 | Fisher et al. | 292/216 |
| 6,655,088 | B1 * | 12/2003 | Hörmann | 49/200 |
| 2002/0069585 | A1 | 6/2002 | Schiks | 49/200 |
| 2002/0170688 | A1 | 11/2002 | Daus et al. | 160/315 |

FOREIGN PATENT DOCUMENTS

| | | | |
|---|---|---|---|
| DE | 20112521 | | 11/2001 |
| EP | 0151427 | * | 1/1986 |
| EP | 1213428 | | 6/2002 |

* cited by examiner

BRAKING DEVICE FOR GARAGE DOORS AND THE LIKE

FIELD OF THE INVENTION

The present invention relates to a braking device for garage doors and the like. More particularly, the present invention relates to a braking device, also known in the industry as a "spring break device", configured for use with a counterbalancing system of a door, such as a garage door for example. The present invention also relates to a counterbalancing system provided with such a braking device and to a kit for assembling the braking device. The braking device is intended to brake the garage door in case of a failure in the counterbalancing system (e.g., a failure of the counterbalancing spring).

BACKGROUND OF THE INVENTION

Garage doors and the like are well known in the art. Indeed, it is well known in the art that garage doors usually require to be connected to a counterbalancing system for counterbalancing the weight of the door in order to decrease the force required to open the door and also safely facilitate its closing from a raised to a lowered position. Counterbalancing systems can be found in many other types of cable-operated doors, such as slidable truck doors for example.

It is also known in the art that a widely used type of counterbalancing system generally comprises a pair of spaced apart cable drums connected to corresponding cables, each cable being in turn connected to a lower opposite side edge of the garage door. The cable drums are usually mounted on an overhead shaft which is supported above the door opening and is connected to one or more torsion springs which are each fixed to the shaft at one end, and operatively secured to a fixed structure such as the wall, or a wall bracket for example, at the other end, so that the cable drums are biased to rotate in a direction which winds the cables onto the drums and counteracts the weight of the door connected to the cables. The torsion springs are adjusted to properly balance the weight of the door so that minimal opening and closing efforts are required, either manually or when motor controlled.

It is also known in the art that conventional, low cost adjustment devices used for the above-mentioned type of counterbalancing system, and widely utilized in the garage door industry, are generally cylindrical "collars" commonly referred to also as "plugs" (or "cones") which are connected to the ends of the torsion springs and are thus mounted on the aforementioned shaft for adjusting the deflection of the springs to preset the torsional (or counterbalancing) force of the spring.

In operation, torque is transferred between the torsion spring, overhead shaft, and plugs which operatively connect the shaft to the spring, in order to counterbalance the weight of the garage door. Usually, each torsion spring is fixed to the overhead shaft at one end, by means of a plug known as a "winding plug", and operatively secured to the wall via a bracket at the other end, by means of another plug known as a "stationary plug".

One could envisage that, although very unlikely, it might happen that one of the elements (e.g. spring, of the counterbalancing mechanism may undergo a failure, leading to the garage door falling which is undesirable.

There have been many attempts to come up with braking devices which are used for slowing descent of a garage door and/or immobilizing the garage door in the event of a failure in its counterbalancing mechanism.

Known in the art is American patent application No. US 2002/0069685 A1 naming SCHIKS as inventor and published on Jun. 13$^{th}$, 2002, which describes a drop-catch mechanism. The drop-catch mechanism is used for preventing a door leaf of an overhead door from falling down upon breakage of a balancing spring thereof. The mechanism comprises an input member for coupling with a balancing spring of the overhead door. The mechanism also comprises a ratchet wheel for coupling with a winding axle carrying the door leaf of the overhead door. The mechanism also comprises a pawl and means for moving the pawl form a free position that allows rotation of the ratchet wheel to a catching position that blocks rotation of the ratchet wheel. The means for moving the pawl are configured such that, in use, breakage of a balancing spring coupled to the input member causes the pawl to move from the free position to the catching position. The mechanism is characterized in that the means for moving the pawl from the free position into the catching position comprise a positive mechanical drive extending from the input member to the pawl.

Also known to the Applicant are the following U.S. patents and patent application which describe various devices for use with doors: U.S. Pat. Nos. 229,983; 603,237; 636,645; 826,284; 1,196,714; 1,863,961; 2,463,344; 2,546,081; 2,555,560; 2,878,865; 3,236,348; 3,842,892; 3,895,539; 4,116,314; 4,125,142; 5,257,685; 5,494,093; 5,706,552; 5,971,055; 6,070,641; 6,079,524; 6,102,480; 6,401,792; 6,431,619; and 2002/0170688 A1.

However, some of these devices are generally quite bulky; inherently elaborate; difficult to use, install, and/or maintain; and/or result to be cost ineffective.

Therefore, there is a need for a simpler, more compact, easier to use, easier to maintain, and/or more cost effective braking device than what is available in the prior art for stopping downward movement of a cable-operated door, such as garage doors and the like, in the event of a failure in the counterbalancing system of the door (for example, failure of one of the counterbalancing springs and/or failure of one of the elements connected to the counterbalancing springs).

SUMMARY OF THE INVENTION

The object of the present invention is to provide a braking device which, by virtue of its design and components, satisfies some of the above-mentioned needs and is thus an improvement over other related braking devices known in the prior art.

The present invention is particularly advantageous in that it is intended for immobilizing a cable-operated door, such as garage doors and the like, in the event of a failure in the counterbalancing system of the door, in order to impede free falling of the door thereby preventing damages to property and personal injuries to people.

In accordance wit the present invention, the above object is achieved with a braking device configured for use with a counterbalancing system of a door, said counterbalancing system including a rotatable overhead shaft operatively connected to the door for operating the same, a plug mounted about the overhead shaft and being rotatable thereabout, and a torsional spring operatively connecting the plug to the overhead shaft and being loaded thereinbetween so as to exert a torsional force capable of counterbalancing the weight of the door, said torsional force being transmittable between the overhead shaft and the plug via the torsional spring, the braking device being used for blocking rotation of the overhead shaft in the event of a failure of the counterbalancing system of the door, the braking device comprising:

a support bracket rigidly connected to a fixed structure, said support bracket having a guiding arrangement;

a ratchet wheel securely mounted about the overhead shaft of the counterbalancing system, the ratchet wheel having a least one notch;

a pawl arm having first and second ends, the first end of the pawl arm being pivotably connected to the support bracket and the second end of the pawl arm cooperating with the guiding arrangement and being movable with respect to the support bracket along a given path defined by the guiding arrangement, the first and seconds ends of the pawl arm being further connected to flanges of the plug on either side of the overhead shaft, the pawl arm further having an element adjacent to the ratchet wheel, said element being shaped and sized to be removably insertable into said at least one notch of the ratchet wheel so as to block rotation of the ratchet wheel; and biasing means operatively connected between the support bracket and the pawl arm so as to exert a biasing force for biasing the pawl arm and its element towards the ratchet wheel;

wherein the pawl arm is operable between a first configuration, corresponding to a normal operation of the counterbalancing system, where the torsional force of the torsional spring transmitted to the plug is greater than the biasing force of the biasing means acting on the pawl arm, thereby urging the pawl arm and its element away from the ratchet wheel, thus allowing the overhead shaft to rotate, and a second configuration, corresponding to a failure of the counterbalancing system, where the biasing force of the biasing means acting on the pawl arm is greater than the torsional force of the torsional spring transmitted to the plug, thereby urging the element of the pawl arm into said at least one notch of the ratchet wheel so as to block rotation of the pawl arm and thus block rotation of the overhead shaft.

According to another aspect of the present invention, there is also provided a counterbalancing system including a rotatable overhead shaft operatively connected to a door for operating the same, a plug mounted about the overhead shaft and being rotatable thereabout, and a torsional spring operatively connecting the plug to the overhead shaft and being loaded thereinbetween so as to exert a torsional force capable of counterbalancing the weight of the door, said torsional force being transmittable between the overhead shaft and the plug via the torsional spring, the counterbalancing system further including a braking device used for blocking rotation of the overhead shaft in the event of a failure of the counterbalancing system, the braking device comprising:

a support bracket rigidly connected to a fixed structure, said support bracket having a guiding arrangement;

a ratchet wheel securely mounted about the overhead shaft of the counterbalancing system, the ratchet wheel having a least one notch;

a pawl arm having first and second ends, the first end of the pawl arm being pivotably connected to the support bracket and the second end of the pawl arm cooperating with the guiding arrangement and being movable with respect to the support bracket along a given pat defined by the guiding arrangement, the first and seconds ends of the pawl arm being further connected to flanges of the plug on either side of the overhead shaft, the pawl arm further having an element adjacent to the ratchet wheel, said element being shaped and sized to be removably insertable into said at least one notch of the ratchet wheel so as to block rotation of the ratchet wheel; and biasing means operatively connected between the support bracket and the pawl arm so as to exert a biasing force for biasing the pawl arm and its element towards the ratchet wheel;

wherein the pawl arm is operable between a first configuration, corresponding to a normal operation of the counterbalancing system where the torsional force of the torsional spring transmitted to the plug is greater than the biasing force of the biasing means acting on the pawl arm, thereby urging the pawl arm and its element away from the ratchet wheel, thus allowing the overhead shaft to rotate, and a second configuration, corresponding to a failure of the counterbalancing system, where the biasing force of the biasing means acting on the pawl arm is greater than the torsional force of the torsional spring transmitted to the plug, thereby urging the element of the pawl arm into said at least one notch of the ratchet wheel so as to block rotation of the pawl arm and thus block rotation of the overhead shaft.

According to another aspect of the present invention, there is also provided a kit for assembling a braking device configured for use with a counterbalancing system of a door, said counterbalancing system including a rotatable overhead shaft operatively connected to the door for operating the same, a plug mounted about the overhead shaft and being rotatable thereabout, and a torsional spring operatively connecting the plug to the overhead shaft and being loaded thereinbetween so as to exert a torsional force capable of counterbalancing the weight of the door, said torsional force being transmittable between the overhead shaft and the plug via the torsional spring, the braking device being used for blocking rotation of the overhead shaft in the event of a failure of the counterbalancing system of the door, the kit comprising:

a support bracket rigidly connectable to a fixed structure, said support bracket having a guiding arrangement;

a ratchet wheel securely mountable about the overhead shaft of the counterbalancing system, the ratchet wheel having a least one notch;

a pawl arm having first and second ends, the first end of the pawl arm being pivotably connectable to the support bracket and the second end of the pawl arm being also connectable to the support bracket for cooperating with the guiding arrangement and moving with respect to the support bracket along a given path defined by the guiding arrangement, the first and seconds ends of the pawl arm being further connectable to flanges of the plug, the pawl arm further having an element adjacent to the ratchet wheel, said element being shaped and sized to be removably insertable into said at least one notch of the ratchet wheel so as to block rotation of the ratchet wheel; and biasing means operatively connectable between the support bracket and the pawl arm so as to exert a biasing force for biasing the pawl arm and its element towards the ratchet wheel;

wherein, when the braking device is assembled onto the counterbalancing system, the pawl arm is operable between a first configuration, corresponding to a normal operation of the counterbalancing system, where the torsional force of the torsional spring transmitted to the plug is greater than the biasing force of the biasing means acting on the pawl arm, thereby urging the pawl arm and its element away from the ratchet wheel, thus allowing the overhead shaft to rotate, and a second configuration, corresponding to a failure of the counterbalancing system, where the biasing force of the biasing means acting on the pawl arm is greater than the torsional force of the torsional spring transmitted to the ping, thereby urging the element of the pawl arm into said at least one notch of the ratchet wheel so as to block rotation of the pawl arm and thus block rotation of the overhead shaft.

According to another aspect of the present invention, there is also provided a garage door with corresponding counterbalancing system provided with the above-mentioned braking device.

The objects, advantages and other features of the present invention will become more apparent upon reading of the following non-restrictive description of a preferred embodiment thereof, given for the purpose of exemplification only with reference to the accompanying drawings.

DETAILED DESCRIPTION OF A PREFERRED EMBODIMENT OF THE INVENTION

In the following description, the same numerical references refer to similar elements. The embodiments shown in the figures are preferred.

In the context of the present description, the expression "garage door" includes all types of cable-operated doors and the like. Although the present invention was primarily designed for a garage door, it may be used with other kinds of doors, such as slidable truck doors, or with any other items using a counterbalancing system, as apparent to a person skilled in the art. For this reason, the expression "garage door" should not be taken as to limit the scope of the present invention and includes all other kinds of doors or items with which the present invention may be used and could be useful.

Moreover, in the context of the present description, the expressions "garage" and "door", "torsion spring" and "torsional spring", "counterbalancing shaft" and "overhead shaft", "counterbalancing mechanism" and "counterbalancing system", as well as any other equivalent expressions and/or compound words thereof, may be used interchangeably. The same applies for any other mutually equivalent expressions, such as "plate" and "bracket" for example, as apparent to a person skilled in the art.

In addition, although the preferred embodiment of the present invention as illustrated in the accompanying drawings comprises various components such as fastener(s), a bracket, a guiding slot, a spring member, bushing(s), spacer(s), etc., and although the preferred embodiment of the braking device 1 and corresponding parts of the present invention as shown consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the braking device 1 according to the present invention, as will be briefly explained herein and as can be easily inferred herefrom, without departing from the scope of the invention.

Broadly described, the braking device 1 according to the present invention, as exemplified in the accompanying drawings, is a braking device 1 for use with a counterbalancing system 3 of a door, such as a garage door, for braking the door in the event of a failure in the counterbalancing system 3, in order to impede free falling of the door.

Figure 1:
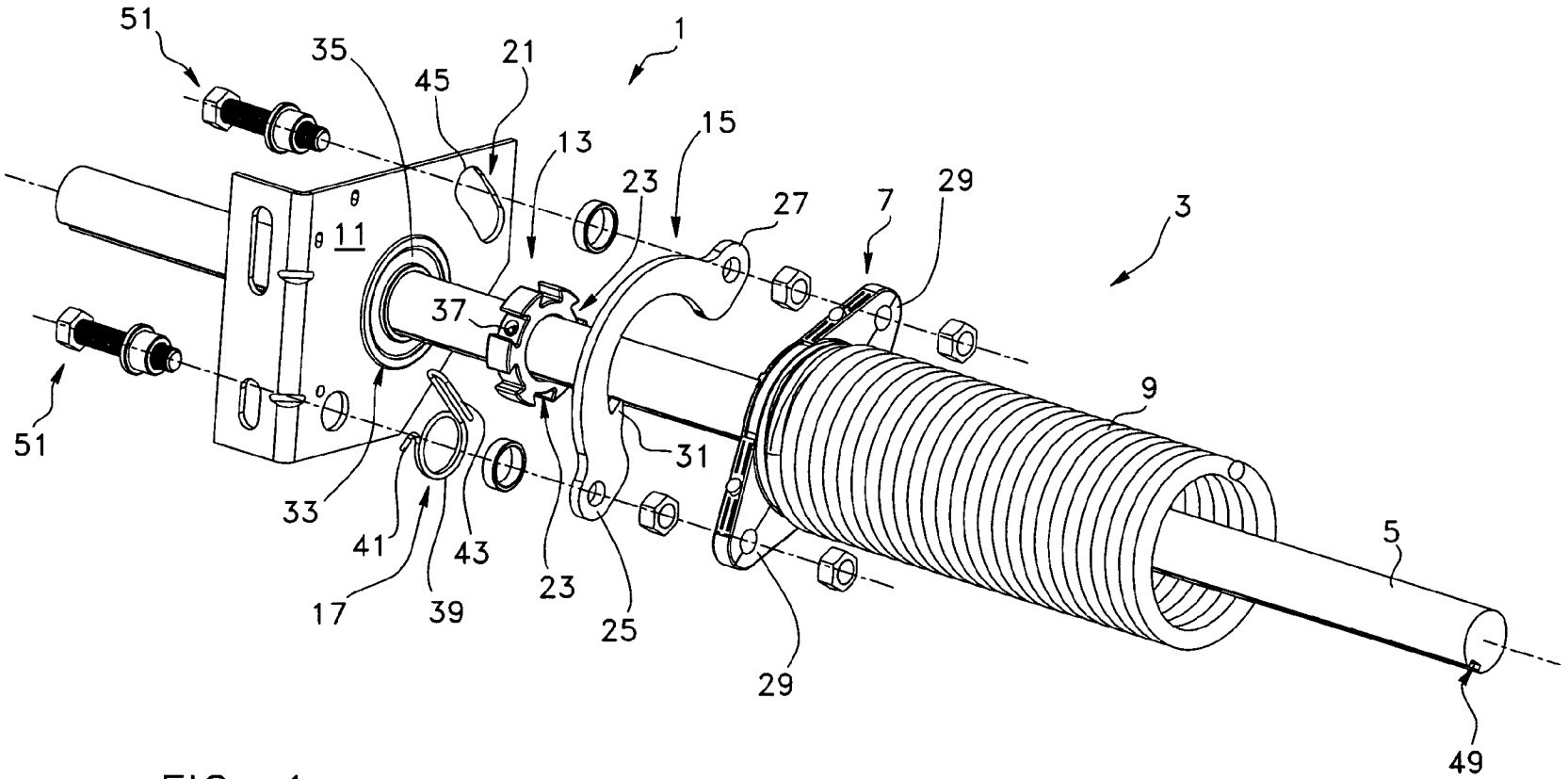
FIG. 1 is a fragmentary exploded view of a counterbalancing system provided with a braking device according to a preferred embodiment of the invention.

As better shown in FIG. 1, the braking device 1 is configured for use with the counterbalancing system 3 of the door which, among other components, typically includes a rotatable overhead shaft 5 operatively connected to the door (not shown) for operating the same, a plug 7 mounted about the overhead shaft 5 and being rotatable thereabout, and a torsional spring 9 operatively connecting the plug 7 to the overhead shaft 5 and being loaded thereinbetween so as to exert a torsional force capable of counterbalancing the weight of the door, the torsional force being transmittable between the overhead shaft 5 and the plug 7 via the torsional spring 9. Counterbalancing systems of garage doors are very well known in the art and thus, in the context of the present description, there is no need to further explain the working principle thereof, as apparent to a person skilled in the art.

According to the present invention, the safety braking device 1 is used for blocking rotation of the overhead shaft 5 in the event of a failure of the counterbalancing system 3 of the door. The braking device 1 comprises a support bracket 11, a ratchet wheel 13, a pawl arm 15, and biasing means 17, as shown in FIGS. 1–5.

Figure 2:
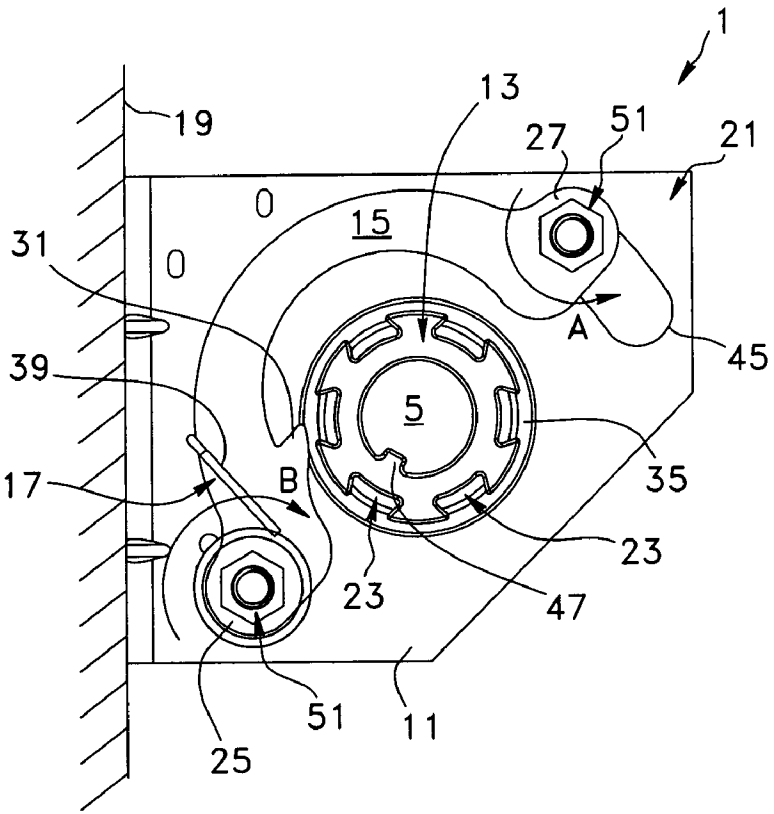
FIG. 2 is a front plan view of the braking device shown in FIG. 1 with its support bracket mounted onto a fixed structure, the braking device being shown assembled and mounted about an overhead shaft, and being also shown in a first unlocked configuration.
Figure 5:
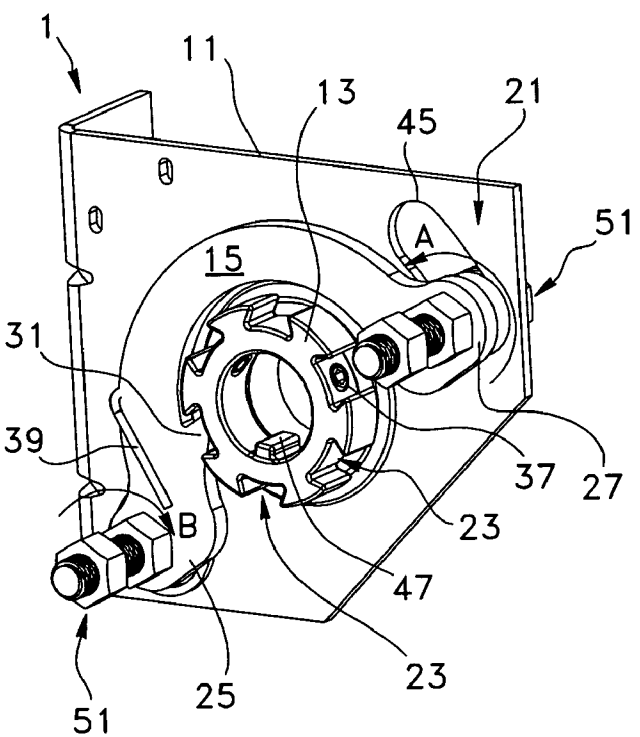
FIG. 5 is a perspective view of the braking device shown in FIG. 4.
Figure 4:
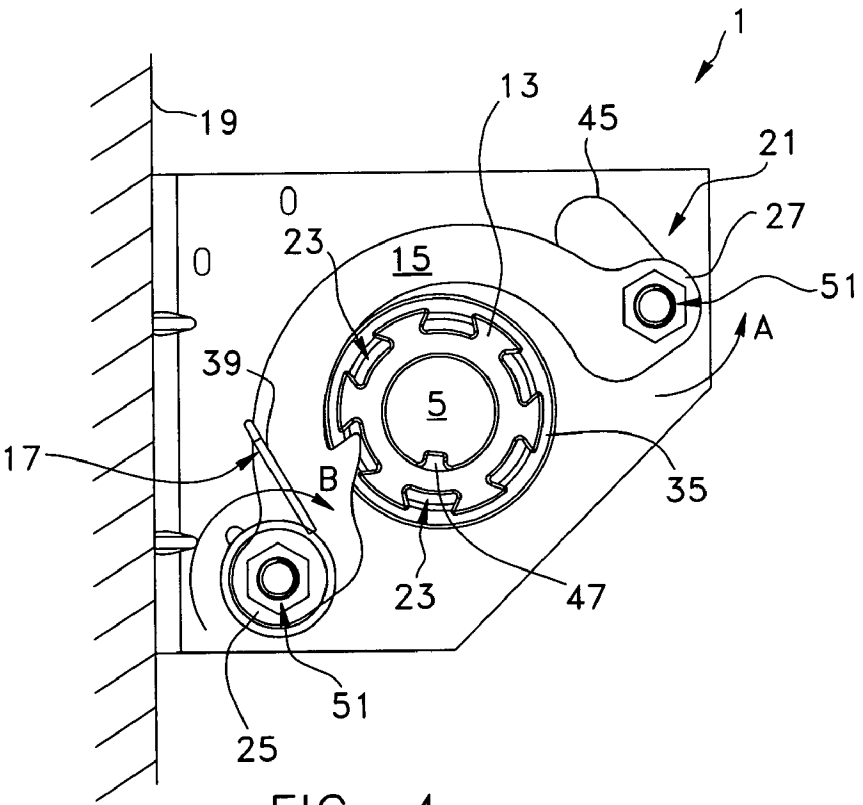
FIG. 4 is a front plan view of the braking device shown in FIG. 1 with its support bracket mounted onto a fixed structure, the safety braking device being shown assembled and mounted about an overhead shaft the braking device being further shown in a second locked configuration.

As better shown in FIGS. 2 and 4, the support bracket 11 is rigidly connected to a fixed structure 19, such as a wall for example, or any other suitable structure. The braking device 1 also has a guiding arrangement 21, which preferably includes a guiding slot 45 provided on the support bracket 11. It is worth mentioning though that, according to the present invention, the guiding arrangement 21 may be disposed otherwise on the braking device 1 and/or on other parts of the counterbalancing system 3 with which it cooperates, as briefly described hereinbelow and as apparent to a person skilled in the art.

As shown in FIGS. 1–5, the ratchet wheel 11 is securely mounted about the overhead shaft 5 of the counterbalancing system 3 and has at least one notch 23. Preferably, the ratchet wheel 13 is securely mounted about the overhead shaft 5 by means of suitable fasteners, such as setscrews 37 for example, as better shown in FIGS. 1, 3 and 5. Preferably also, the ratchet wheel 13 further comprises an inner bore provided with a tenon 47 removably insertable into a corresponding longitudinal mortise 49, or groove, provided along the overhead shaft 5, as better shown in FIG. 1. It is worth mentioning that, according to the present invention, other suitable means different from the above-discussed may be used for securely mounting the ratchet wheel 13 about the overhead shaft 5, at a suitable location therealong, as apparent to a person skilled in the art.

As shown in FIGS. 1–5, the pawl arm 15 has first and second ends 25, 27. The first end 25 of the pawl arm 15 is pivotally connected to the support bracket 11. The second end 27 of the pawl arm 15 cooperates with the guiding arrangement 21 and is movable with respect to the support bracket 11 along a given path defined by the guiding arrangement 21, as can be easily understood when comparing FIGS. 2 and 3 with FIGS. 4 and 5. The first and second ends 25, 27 of the pawl arm 15 are further connected to flanges 29 of the plug 7 on either side of the overhead shaft 5, as better shown in FIG. 1.

As aforementioned, the guiding arrangement 21 of the support bracket 11 preferably comprises a guiding slot 45, preferably provided on the support bracket 11, which preferably acts as the given path along which the second end 27 of the pawl arm 15 may travel. Preferably also, the braking device 1 comprises suitable fasteners 51 for connecting the first and second ends 25, 27 of the pawl arm 15 to the flanges 29 of the plug 7, one of the fasteners 51 being preferably mounted onto the second end 27 of the pawl arm 15 and cooperating with the guiding slot of the support bracket 11 for allowing the second end 27 of the pawl arm 15 to move along the guiding slot of the support bracket 11, as can be easily understood when comparing FIGS. 2 and 3 with FIGS. 4 and 5. The fasteners may simply consist of a member having a first end securely connected to the second end 27 of the pawl arm 15 and a second end cooperating with the guiding arrangement 21 (e.g. slot 45) of the support bracket 11. Alternatively, the fasteners may consist of a bolt combined with other suitable complementary pieces, such as a nut, a washer, a spacer, a bearing, and/or the like, as exemplified in FIG. 1 and as apparent to a person skilled in the art.

Figure 3:
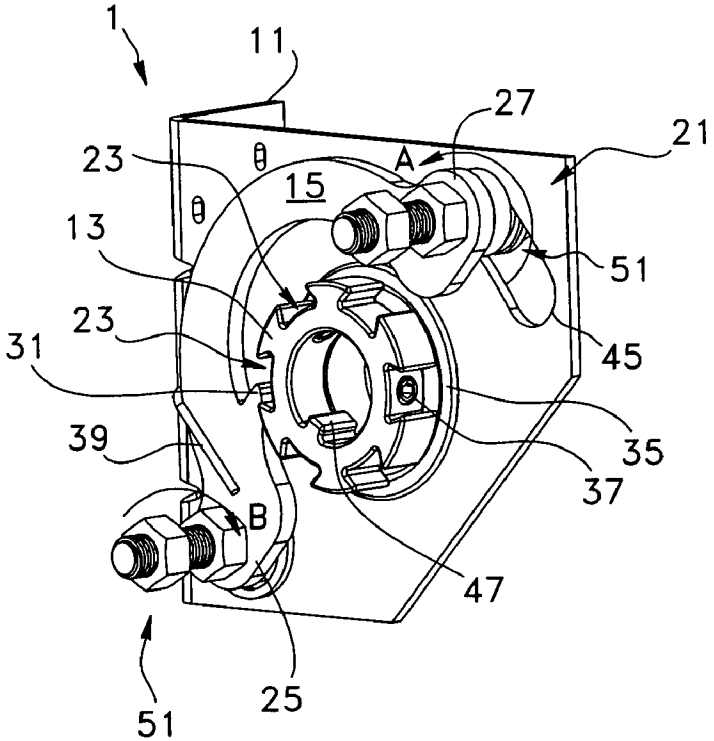
FIG. 3 is a perspective view of the braking device shown in FIG. 2.

As better shown in FIGS. 2–4, the pawl arm 15 further has an element 31 adjacent to the ratchet wheel 13, said element 31 being shaped and sized to be removably insertable into at least one notch 23 of the ratchet wheel 13 so as to block rotation of the ratchet wheel 13 when there is a failure of the counterbalancing system 3.

As shown in FIGS. 1–5, the biasing means 17 are operatively connected between the support bracket 11 and the pawl arm 15 so as to exert a biasing force for biasing the pawl arm 15 and its element 31 towards the ratchet wheel 13. The biasing means preferably comprise a loaded spring member 39, capable of storing potential energy via deformation so as to provide a potential force, the spring member 39 having a first end 41 connected to the support bracket 11 and a second end 43 resting against the pawl arm 15. It is worth mentioning however that other suitable biasing means 17 which do not use potential energy for providing a biasing force may be used according to the present invention, so long as these biasing means 17 are capable of biasing the pawl arm 15 and its element 31 in a suitable way towards the ratchet wheel 13, as apparent to a person skilled in the art.

In use, the pawl arm 15 is operable between a first configuration, also known as "unlocked configuration", corresponding to a normal operation of the counterbalancing system 3, where the torsional force of the torsional spring 9 transmitted to the plug 7 is greater than the biasing force of the biasing means 17 acting on the pawl arm 15, thereby urging the pawl arm 15 and its element 31 away from the ratchet wheel 13, as better shown in FIGS. 2 and 3, thus allowing the overhead shaft 5 to rotate and operate normally, as apparent to a person skilled in the art.

The pawl arm 15 is also operable and may be triggered into a second configuration, also known as the "locked configuration", corresponding to a failure of the counterbalancing system 3, where the biasing force of the biasing means 17 acting on the pawl arm 15 is greater than the torsional force of the torsional spring 9 transmitted to the plug 7, thereby urging the element of the pawl arm 15 into at least one notch 23 of the ratchet wheel 13 so as to block rotation of the pawl arm 15 and thus block rotation of the overhead shaft 5, as better shown in FIGS. 3 and 4, and as also apparent to a person skilled in the art.

It is worth mentioning that although the preferred embodiment of the guiding arrangement 21 includes a guiding slot 45 provided on the support bracket 11, other suitable guiding arrangements 21 different from the above-discussed may be used for the braking device 1 according to the present invention, without departing from the scope of the present invention. For example, the support bracket 11 may not even need to be provided with a guiding slot 45. Indeed, the support bracket 11 could be provided with an appropriate projecting member instead, such as a pin, which would be shaped and sized to cooperate with a corresponding guiding slot 45 provided on the second end 27 of the pawl arm 15 so as to ensure a proper cooperation thereinbetween and assure that the second end 27 of the pawl arm 15 may be displaced from one end to another along the predetermined given path so that the pawl arm 15 may be properly triggered from the first configuration into the second configuration so as to ensure that its element 31 is securely insertable into one of the notches 23 of the ratchet wheel 15, so as to block rotation of the overhead shaft 5, in the event of a failure of the counterbalancing system 3. Moreover, it is worth mentioning that according to other variations of the present invention, the pawl arm 15 could be integrated into the plug 7 so that the latter two would consist of one single piece. Indeed, this modified plug 7 would thus have first and second ends 25, 27, similarly to those described herein, and a corresponding element 31 being shaped and sized to be removably insertable into at least one notch 23 of the ratchet wheel 13 so as to block rotation of the ratchet wheel 13. Hence, as can be easily understood, other various types of guiding arrangements 21 and substantial variations of the pawl arm 15 may be used according to the present invention so long as they ensure a proper displacement of the second end 27 of the pawl arm 15 with respect to the support bracket 11 for ensuring blocking of the ratchet wheel 13 by means of element 31, and thus ensuring blocking of the overhead shaft 5, in the event of a failure of the counterbalancing mechanism 3.

Preferably also, the given path along which the second end 27 of the pawl arm 15 may travel is preferably devised so that the displacement of the pawl arm 15 into the locked configuration forces the plug 7 of the counterbalancing mechanism 3 to be displaced eccentrically with respect to the longitudinal axis of the overhead shaft 5 so as to facilitate the insertion of the element 31 of the pawl arm 15 into one of the plurality of notches 23 of the ratchet wheel 13, and thus adequately block rotation of the ratchet wheel 13, and thus of the overhead shaft 5, when there is a failure in the counterbalancing mechanism 3.

As better shown in FIGS. 2–4, the ratchet wheel 13 preferably comprises a plurality of notches 23, and the element 31 of the pawl arm 15 is removably insertable into one of said notches 23 when the pawl arm 15 is triggered into the second configuration.

As better shown in FIGS. 2 and 4, the support bracket 11 preferably comprises an orifice 33 through which the overhead shaft 5 extends. As also shown, the orifice 33 is preferably provided with a bushing 35 through which the overhead shaft 5 also extends, said bushing 35 acting as a support for the overhead shaft 5 and also facilitating its rotation with respect to the support bracket 11, also known as a bearing plate.

Preferably also, the pawl arm 15 is arc-shaped, as better shown in FIGS. 1–5, and the first and second ends 25, 27 of the pawl arm 15 are preferably diametrically opposed to one another, as better shown in FIGS. 2–4. It is worth mentioning though, as apparent to a person skilled in the art, that the first and second ends 25, 27 of the pawl arm 15 do not necessarily need to be diametrically opposite to one another, for proper operation of the braking device 1, that is, for a suitable blocking of the ratchet wheel 13 by the pawl arm 15 and its element 31. Indeed, the second end 27 of the pawl arm 15 and corresponding guiding arrangement 21 may be located at another suitable location on the support bracket 11 for providing a proper lever force so as to insert the element 31 of the pawl arm 15 securely into one of the notches 23 of the ratchet wheel 13 and adequately block rotation of the overhead shaft 5 when there is a failure in the counterbalancing mechanism 3.

As aforementioned, according to another aspect of the present invention, there is also provided a counterbalancing system 3 provided with the above-described braking device 1, as shown in FIG. 1.

Also according to another aspect of the present invention, there is also provided a kit for assembling such as braking device 1.

The ratchet wheel 13 is preferably coaxially mounted onto the shaft 5 and positioned adjacent to the orifice 33 of the plate. As above-discussed, the pawl arm 15 preferably has first and second ends 25, 27, the first end 25 of the pawl arm 15 being pivotally mounted onto the plate and the second end 27 of the pawl arm 15 being slidably movable along a guiding slot of the plate. The pawl arm 15 preferably also has an element 31 positioned to be insertable into a notch 23 of the ratchet wheel 13. Preferably also, the plug 7 of the counterbalancing mechanism has first and second flanges 29 being respectively mounted onto the first and second ends 25, 27 of the pawl arm 15. Preferably also, the biasing means 17 are operatively connected between the pawl arm 15 and the bearing plate for biasing the pawl arm 15 against the ratchet wheel 13 with a potential force for example.

In use, when there is a torsional force in the torsional spring 9 of the counterbalancing mechanism 3 which is greater than the biasing force (e.g. potential force of the spring member 39) of the biasing means 17, then the element 31 of the pawl arm 15 is biased away from the ratchet wheel 13, this mode corresponding to the unlocked configuration of the device 1, as better shown in FIGS. 2 and 3. When the torsional force in the torsional spring 9 of the counterbalancing mechanism is less than the biasing force of the biasing means 17 (i.e. when there is failure in the counterbalancing mechanism 3), then the element 31 of the pawl arm 15 is inserted into the notch 23 of the ratchet wheel 13 via the biasing means 17, this mode corresponding to the locked configuration of the device 1, as better shown in FIGS. 4 and 5.

As aforementioned, a garage door needs to have a counterbalancing system so that it may be more easily opened and closed. The counterbalancing of the door is mainly carried out by the torsional spring 9. This spring 9 is usually fixed to two plugs, the first one being the "winding plug" and the other one being the "stationary plug" 7. The winding plug is usually fixed onto the counterbalancing shaft and the stationary plug 7 is usually fixed onto a bearing plate securely mounted to a fixed structure 19, such as a wall for example, via a bracket. The braking device 1 according to the present invention preferably takes the place of the traditional bearing plate on which the stationary plug 7 is installed.

Indeed, during the normal operation of the door, the braking device 1 according to the present invention is in an unlocked configuration and acts as a wall bracket, as better shown in FIGS. 2 and 3. In this mode, the counterbalancing shaft 5 is free to rotate either clockwise or counterclockwise so as to carry out its normal counterbalancing functions. This unlocked configuration is maintained because of the torsional force present in the torsional spring 9 which is stronger than the force exerted by the biasing means 17, preferably a torsional spring member 39 The torque "A" is caused by the torsional force present in the torsional spring member 39 and the torque "B" is caused by biasing force provided by the biasing means 17 operatively connected between the bearing plate and the pawl arm 15, as better shown in FIGS. 2–5. In the event of a failure in the counterbalancing mechanism characterized by a substantial decrease in tension in the torsional spring 9, ten torque "A" becomes very small, therefore the combined effect of gravity on the door and the potential force present in the biasing means 17 force the pawl arm 15 to engage with the ratchet wheel 13, as better shown in FIGS. 4 and 5, and thereby reduces the risk of the door falling. Indeed, when in the locked configuration, the counterbalancing shaft 9 is prevented from rotating because of the interlocking of the element 31 of the pawl arm 15 with a corresponding notch 23 of the ratchet wheel 13 mounted securely and coaxially about the counterbalancing shaft 9. Preferably and as apparent to a person skilled in the art, the shaft 9 may only be turned by raising the door or by appropriately disengaging the pawl arm 15 from the ratchet wheel 13. Hence, it can be easily understood that the braking device 1 according to the present invention acts similarly to a ratchet system which is triggered into action when there is a failure in the counterbalancing mechanism 3 of the door.

The braking device 1 and corresponding parts (pawl arm 15, ratchet wheel 13, support bracket 11, etc.) are preferably made of substantially rigid materials, such as metallic materials (steel, etc.), hardened polymers, composite materials, and/or the like, so as to ensure a proper operation thereof depending on the particular applications for which the braking device 1 is intended and the different parameters in cause (counterbalancing force in the spring 9, weight of the door, etc.), as apparent to a person skilled in the art.

The present invention is an improvement and presents several advantages over devices known on the prior art. Indeed, the present invention may be used in the garage door industry, with new garage doors or existing garage doors. In the case of a failure in the counterbalancing system 3, the present invention is devised to brake the fall of the garage door and/or maintain it immobilized where it is until the necessary inspections and repairs are made. As it is evident from reading the above description, the present invention is a device 1 used for braking a cable-operated door, such as garage doors and the like, in the event of a failure of one of the cables operating such cable-operated door or in the event of a failure of one of the elements holding the cables (e.g. torsional spring breaking, etc.). In such cases, the present invention is devised to impede free falling of the cable-operated door and thus prevent or at the very least reduce adverse results. Furthermore, the present invention may be used with other kinds of doors, such as slidable truck doors, or with any other items provided with counterbalancing mechanisms 3 such as the aforementioned, as apparent to a person skilled in the art.

Of course, numerous modifications could be made to the above-described embodiments without departing the scope of the invention, as defined in the appended claims.

What is claimed is:

1. A braking device configured for use with a counterbalancing system of a door, said counterbalancing system including a rotatable overhead shaft operatively connected to the door for operating the same, a plug mounted about the overhead shaft and being rotatable thereabout, and a torsional spring operatively connecting the plug to the overhead shaft and being loaded thereinbetween so as to exert a torsional force capable of counterbalancing the weight of the door, said torsional force being transmittable between the overhead shaft and the plug via the torsional spring, the braking device being configured for blocking rotation of the overhead shaft in the event of a failure of the counterbalancing system of the door, the braking device comprising:

a support bracket rigidly connectable onto a fixed structure, said support bracket having a guiding arrangement;

a ratchet wheel configured fur securely mounting about the overhead shaft of the counterbalancing system, the ratchet wheel having a least one notch on an outer surface thereof;

a pawl arm having first and second ends, the first end of the pawl arm being directly pivotably connected to the support bracket and the second end of the pawl arm cooperating with the guiding arrangement and being movable with respect to the support bracket along a given path defined by the guiding arrangement, the first and seconds ends of the pawl arm being further configured for direct connection onto flanges of the plug on respective opposing sides of the overhead shaft, the pawl arm further having an element adjacent to the ratchet wheel, said element being shaped and sized to be removably insertable into said at least one notch of the ratchet wheel so as to block rotation of the ratchet wheel; and biasing means operatively connected between the support bracket and the pawl arm so as to exert a biasing force for biasing the pawl arm and its element towards the ratchet wheel;

wherein the braking device is configured to cooperate with the counterbalancing system in such a way that the pawl arm is operable between a first configuration, corresponding to a normal operation of the counterbalancing system, where the torsional force of the torsional spring transmitted to the plug is greater than the biasing force of the biasing means acting on the pawl arm, thereby urging the pawl arm and its element away from the ratchet wheel, thus allowing the overhead shaft to rotate, and a second configuration, corresponding to a failure of the counterbalancing system, where the biasing force of the biasing means acting on the pawl arm is greater than the torsional force of the torsional spring transmitted to the plug, thereby urging the element of the pawl arm into said at least one notch of the ratchet wheel so as to block rotation of the pawl arm and thus block rotation of the overhead shaft.

2. A braking device according to claim 1, wherein the ratchet wheel comprises a plurality of notches, and wherein the element of the pawl arm is removably insertable into one of said notches when the pawl arm is triggered into the second configuration.

3. A braking device according to claim 1, wherein the support bracket comprises an orifice through which the overhead shaft is insertable, said orifice being provided with a bushing through which the overhead shaft is also insertable.

4. A braking device according to claim 1, wherein the ratchet wheel is configured for securely mounting about the overhead shaft by means of setscrews.

5. A braking device according to claim 1, wherein the ratchet wheel comprises an inner bore provided with a tenon removably insertable into a corresponding longitudinal mortise provided along the overhead shaft.

6. A braking device according to claim 1, wherein the biasing means comprise a loaded spring member having a first end connected to the support bracket and a second end resting against the pawl arm.

7. A braking device according to claim 1, wherein the pawl arm is arc-shaped.

8. A braking device according to claim 1, wherein the first and second ends of the pawl arm are diametrically opposed to one another.

9. A braking device according to claim 1, the guiding arrangement of the support bracket comprises a guiding slot acting as the given path and wherein the braking device comprises fasteners for connecting the first and second ends of the pawl arm to the flanges of the plug, one of said fasteners being mounted onto the second end of the pawl arm and cooperating with the guiding slot of the support bracket for allowing the second end of the pawl arm to move along said guiding slot of the support bracket.

10. A safety braking device according to claim 1, wherein:

the ratchet wheel comprises a plurality of notches;

the element of the pawl arm is insertable into one of said notches when the pawl arm is triggered into the second configuration;

the support bracket comprises an orifice through which the overhead shaft is insertable, said orifice being provided with a bushing through which the overhead shaft is also insertable;

the biasing means comprise a loaded spring member having a first end connected to the support bracket and a second end resting against the pawl arm;

the pawl arm is arc-shaped;

the first and second ends of the pawl arm are diametrically opposed to one another; and the guiding arrangement of the support bracket comprises a guiding slot acting as the given path and the braking device comprises fasteners for connecting the first and second ends of the pawl arm to the flanges of the plug, one of said fasteners being mounted onto the second end of the pawl arm and cooperating with the guiding slot of the support bracket for allowing the second end of the pawl arm to move along said guiding slot of the support bracket.

11. A counterbalancing system including a rotatable overhead shaft operatively connected to a door for operating the same, a plug mounted about the overhead shaft and being rotatable thereabout, and a torsional spring operatively connecting the plug to the overhead shaft and being loaded thereinbetween so as to exert a torsional force capable of counterbalancing the weight of the door, said torsional force being transmittable between the overhead shaft and the plug via the torsional spring, the counterbalancing system further including a braking device used for blocking rotation of the overhead shaft in the event of a failure of the counterbalancing system, the braking device comprising:

a support bracket rigidly connected to a fixed structure, said support bracket having a guiding arrangement;

a ratchet wheel securely mounted about the overhead shaft of the counterbalancing system, the ratchet wheel having a least one notch;

a pawl arm having first and second ends, the first end of the pawl arm being directly pivotably connected to the support bracket and the second end of the pawl arm cooperating with the guiding arrangement and being movable wit respect to the support bracket along a given path defined by the guiding arrangement, the first and seconds ends of the pawl arm being further connected to flanges of the plug on either side of the overhead shaft, the pawl arm further having an element adjacent to the ratchet wheel, said element being shaped and sized to be removably insertable into said at least one notch of the ratchet wheel so as to block rotation of the ratchet wheel; and biasing means operatively connected between the support bracket and the pawl arm so as to exert a biasing force for biasing the pawl arm and its element towards the ratchet wheel;

wherein the pawl arm is operable between a first configuration, corresponding to a normal operation of the counterbalancing system, where the torsional force of the torsional spring transmitted to the plug is greater than the biasing force of the biasing means acting on the pawl arm, thereby urging the pawl arm and its element away from the ratchet wheel, thus allowing the overhead shaft to rotate, and a second configuration, corresponding to a failure of the counterbalancing system, where the biasing force of the biasing means acting on the pawl arm is greater than the torsional force of the torsional spring transmitted to the plug, thereby urging the element of the pawl arm into said at least one notch of the ratchet wheel so as to block rotation of the pawl arm and thus block rotation of the overhead shaft.

12. A counterbalancing system according to claim 11, wherein the ratchet wheel comprises a plurality of notches, and wherein the element of the pawl arm is removably insertable into one of said notches when the pawl arm is triggered into the second configuration.

13. A counterbalancing system according to claim 11, wherein the support bracket comprises an orifice through which the overhead shaft extends, said orifice being provided with a bushing through which the overhead shaft also extends.

14. A counterbalancing system according to claim 11, wherein the ratchet wheel is securely mounted about the overhead shaft by means of setscrews.

15. A counterbalancing system according to claim 11, wherein the ratchet wheel comprises an inner bore provided with a tenon removably insertable into a corresponding longitudinal mortise provided along the overhead shaft.

16. A counterbalancing system according to claim 11, wherein the biasing means comprise a loaded spring member having a first end connected to the support bracket and a second end resting against the pawl arm.

17. A counterbalancing system according to claim 11, wherein the pawl arm is arc-shaped.

18. A counterbalancing system according to claim 11, wherein the first and second ends of the pawl arm are diametrically opposed to one another.

19. A counterbalancing system according to claim 11, the guiding arrangement of the support bracket comprises a guiding slot acting as the given path and wherein the braking device comprises fasteners for connecting the first and second ends of the pawl arm to the flanges of the plug, one of said fasteners being mounted onto the second end of the pawl arm and cooperating with the guiding slot of the support bracket for allowing the second end of the pawl arm to move along said guiding slot of the support bracket.

20. A counterbalancing system according to claim 11, wherein:

the ratchet wheel comprises a plurality of notches;

the element of the pawl arm is insertable into one of said notches when the pawl arm is triggered into the second configuration;

the support bracket comprises an orifice through which the overhead shaft extends, said orifice being provided with a bushing through which the overhead shaft also extends;

the biasing means comprise a loaded spring member having a first end connected to the support bracket and a second end resting against the pawl arm;

the pawl arm is arc-shaped;

the first and second ends of the pawl arm are diametrically opposed to one another; and the guiding arrangement of the support bracket comprises a guiding slot acting as the given path and the braking device comprises fasteners for connecting the first and second ends of the pawl arm to the flanges of the plug, one of said fasteners being mounted onto the second end of the pawl arm and cooperating with the guiding slot of the support bracket for allowing the second end of the pawl arm to move along said guiding slot of the support bracket.

* * * * *